US007926812B2

(12) United States Patent
Perkins

(10) Patent No.: US 7,926,812 B2
(45) Date of Patent: Apr. 19, 2011

(54) COLLECTOR-TARGETED, MEMORABILIA-BEARING TRADING CARD SET WITH BORDERLESS EDGE PORTIONS

(75) Inventor: David P. Perkins, Morrisville, NC (US)

(73) Assignee: USA Baseball, Durham, NC (US)

( * ) Notice: Subject to any disclaimer, the term of this patent is extended or adjusted under 35 U.S.C. 154(b) by 201 days.

(21) Appl. No.: 11/938,329

(22) Filed: Nov. 12, 2007

(65) Prior Publication Data

US 2009/0121436 A1 May 14, 2009

(51) Int. Cl.
*A63F 1/00* (2006.01)

(52) U.S. Cl. ..... 273/298

(58) Field of Classification Search ..... None
See application file for complete search history.

(56) References Cited

U.S. PATENT DOCUMENTS

| | | | | |
|---|---|---|---|---|
| 4,215,499 | A | 8/1980 | Wilson | |
| 4,439,941 | A | 4/1984 | Halperin | |
| 5,025,580 | A | 6/1991 | Asai | |
| 5,030,491 | A | 7/1991 | Shoesmith | |
| 5,267,756 | A | 12/1993 | Molee et al. | |
| 5,287,641 | A * | 2/1994 | Showers | 40/488 |
| 5,306,049 | A | 4/1994 | Schireck | |
| 5,407,209 | A * | 4/1995 | Prerost | 273/292 |
| 5,417,431 | A | 5/1995 | Gluck | |
| 5,421,583 | A | 6/1995 | Gluck | |
| 5,597,162 | A * | 1/1997 | Franklin | 273/292 |
| 5,660,391 | A * | 8/1997 | Klasee | 273/292 |
| 5,713,574 | A * | 2/1998 | Hughes | 273/292 |
| 5,803,501 | A * | 9/1998 | Gluck | 283/75 |
| 5,841,878 | A * | 11/1998 | Arnold et al. | 381/124 |
| 6,082,774 | A * | 7/2000 | Schlauch | 283/67 |
| 6,098,323 | A | 8/2000 | McGuiness | |
| 6,098,980 | A * | 8/2000 | Ramage et al. | 273/157 R |
| 6,142,532 | A * | 11/2000 | Gluck | 283/75 |
| 6,543,773 | B2 * | 4/2003 | Mims | 273/292 |
| 6,568,327 | B1 * | 5/2003 | Jones et al. | 101/483 |
| 6,598,879 | B2 * | 7/2003 | Spur et al. | 273/292 |
| 6,722,070 | B2 * | 4/2004 | Ribaudo | 40/800 |
| 6,735,324 | B1 * | 5/2004 | McKinley et al. | 382/100 |
| 6,827,209 | B1 * | 12/2004 | Tank et al. | 206/232 |
| 6,839,453 | B1 | 1/2005 | McWilliam et al. | |
| 6,869,076 | B1 * | 3/2005 | Moore et al. | 273/292 |
| 6,877,746 | B1 * | 4/2005 | Herren et al. | 273/292 |
| 6,981,646 | B2 * | 1/2006 | Lee et al. | 235/486 |
| 7,282,641 | B2 * | 10/2007 | Ueno | 174/50.51 |
| 7,308,986 | B2 * | 12/2007 | Tank et al. | 206/732 |
| D591,356 | S * | 4/2009 | Lanman et al. | D20/19 |

* cited by examiner

*Primary Examiner* — Alvin A Hunter
*Assistant Examiner* — Dolores Collins
(74) *Attorney, Agent, or Firm* — Wood, Herron & Evans, LLP

(57) ABSTRACT

Disclosed is a collector-targeted, memorabilia-bearing trading card set. Each comprises a plurality of cards originating from and assembleable into a set. Each card is formed from at least two layers of material, a first layer being at least a portion of memorabilia having a visual attribute exposed on one side of the card and a second layer that comprises a substrate providing an opposite side surface of the card. The opposite side surface has indicia conveying information related to the memorabilia of the first layer and associating it with the set from which it originated. The memorabilia attribute is positioned to have a portion of the attribute divided between at least two of the cards and extending across adjoining, cut edge portions of at least two cards of the set.

14 Claims, 12 Drawing Sheets

COLLECTOR-TARGETED, MEMORABILIA-BEARING TRADING CARD SET WITH BORDERLESS EDGE PORTIONS

FIELD OF THE INVENTION

The present invention relates to collector-targeted, memorabilia-bearing trading cards originating from and assembleable into a set. More particularly, it relates to cards of a set which each bear a portion of a visual attribute of the memorabilia, such as a team logo, player's number, or autograph, which are cut from a panel of the memorabilia, such as a uniform, and distributed separately so that a collector may later gather and assemble all pieces of a unique set into a substantially contiguous visual recreation of the panel of memorabilia.

BACKGROUND

Collecting trading cards, such as sports cards, continues to be an enormously popular hobby. Particularly rare or unique cards are quite valuable and demand very high prices from enthusiastic collectors.

Various features can be added to or included in trading cards, such as a celebrity autograph or a piece of actual, game-used equipment to make them more sought after because of their uniqueness. "Game-used equipment" typically refers to the fabric of a sports uniform or the covering of a sports ball actually used in a game, but can include many other items. Outside the area of sports, collectable cards have been made which include a small piece of a costume or a small piece from the set of a popular film, for example.

Trading cards that include a small piece of game-used equipment, such as a small swatch of fabric, are commonly called "game-used" cards. Cards in which the swatch includes a portion of a printed or sewn-on patch (by either appliqué or embroidery) are commonly called "patch" cards, a subset of "game-used" cards Approximately 1000 cards can be made from a typical sports jersey, for example. Of those, about 50-100 will includes a portion of an added visual attribute or "patch." As used herein, "memorabilia" is not limited to equipment that was actually used in a game, though that is typically the case.

Typically, a game-used card is made from two laminated layers of substrate, usually cardstock, printed with indicia, such as pictures or information. A window is cut into one of the card layers and the swatch of fabric or other equipment is laminated between the substrate layers so as to be captured and enclosed on all edges of the piece in a "frame." In this manner, the swatch cannot easily be removed and, in the case of fabric, the edges are protected from fraying. An example of such a card assembly is shown in FIGS. 1*a* and 1*b*.

Other game-used or patch cards have included the whole of a discrete visual feature on a uniform, such as a small league logo or a single letter from the team or player's name, on a single card. In the case of a letter, for example, a collector could collect all of the letters from a player's name, but it would be impossible to verify that all of the collected letters came from the same uniform. Even if they had been cut from the same uniform, they could not be reassembled into a visually contiguous appearance of the original whole because the edges of the piece would be separated by a margin created by a border or "frame" element of the card.

SUMMARY OF THE INVENTION

The present invention provides a collector-targeted, memorabilia-bearing trading card set. Each comprises a plurality of cards originating from and assembleable into a set. Each card is formed from at least two layers of material, a first layer being at least a portion of memorabilia having a visual attribute exposed on one side of the card and a second layer that comprises a substrate providing an opposite side surface of the card. The opposite side surface has indicia conveying information related to the memorabilia of the first layer and associating it with the set from which it originated. Each of the cards has a perimeter, at least a portion of which includes a cut edge of the first layer having a borderless appearance. The memorabilia visual attribute is positioned to have a portion of the attribute divided between at least two of the cards and extending across adjoining cut edge portions of at least two cards of the set, giving the edge a borderless appearance.

According to another aspect of the invention, indicia on each card may also provide an identifier unique to each card to facilitate the identification of all cards in a unique set made from a previously-unitary visual attribute. According to another aspect, a separate, electronically-stored image of the complete set, such as a digital photograph taken prior to the attribute being divided, may be viewable by a collector and associated with the unique identifier of each card of the set. A remotely-accessible registry of the unique identifier of each set and each associated card thereof would allow a collector to register ownership of a card and subsequently transfer registration of the card to another collector. Such a registry may also facilitate the location and exchange of cards so that multiple cards from a unique set may be more easily reassembled into a collection of a single collector.

Other features, aspects, and attributes of the present invention will be seen by considering the various figures of the drawing, the detailed description of the best mode for carrying out the invention, and the appended claims.

BRIEF DESCRIPTION OF THE DRAWINGS

Like reference numerals are used to refer to like parts throughout the various figures of the drawing, wherein.

DETAILED DESCRIPTION OF THE PREFERRED EMBODIMENT

Figure 1B:
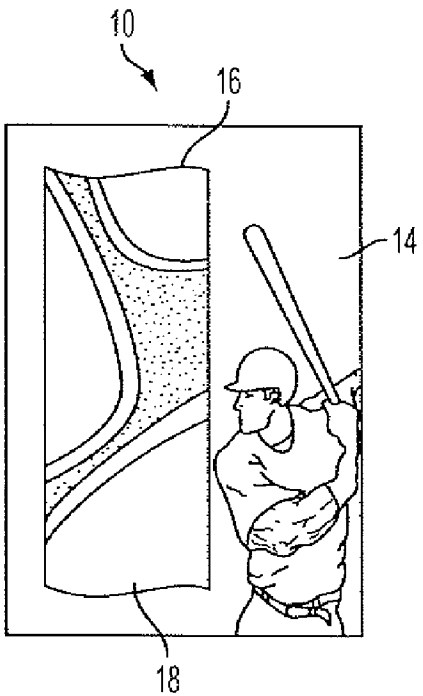
FIG. 1B PRIOR ART
FIG. 1*b* shows an assembled plan view of the prior art card shown in FIG. 1*a;*
Figure 1A:
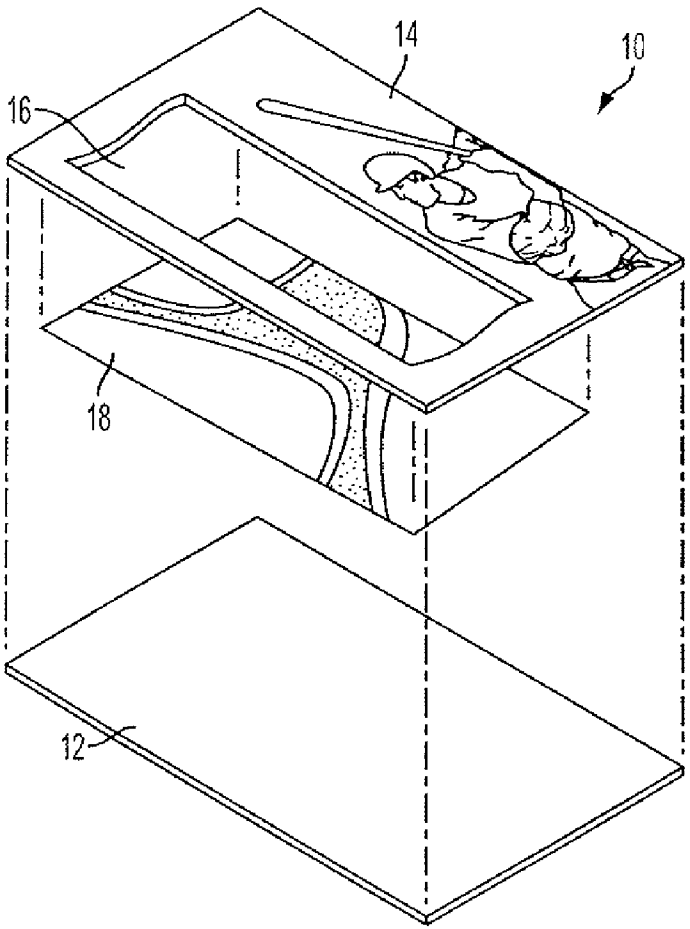
FIG. 1A PRIOR ART
FIG. 1*a* shows an exploded view of a prior art "patch" card.

Ordinary trading cards are typically printed on cardstock and include graphic and/or textual indicia on both sides. Referring to the various figures of the drawing, and first to FIGS. 1*a* and 1*b*, therein is shown at 10 exploded and plan views of a prior art "game-used" or "patch" card. The card 10 includes a backing substrate 12 and framing substrate 14. The substrate material is typically cardboard, which can be laminated into a two-ply assembly, but may be any other suitable material as well. A window 16 is cut in the upper substrate 14 such that when a piece of memorabilia 18 is laminated between the lower and upper substrates 12, 14, it is visible through the cut-out window 16. The window 16 can be formed in any suitable size or shape, but heretofore has been smaller than the overall dimensions of the card 16 and the overall dimensions of the memorabilia 18 such that it forms at least a margin or border area 19 around all sides of the memorabilia swatch 18.

The memorabilia 18 may be any item of collectible significance, value, or desirability capable of being laminated between substrate layers 12, 14. Typically, the memorabilia 18 is a swatch cut from a piece of game-used equipment, such as a uniform or ball cover. Edges of the memorabilia 18 are sealed between the substrate layers 12, 14 when the card 10 is assembled. A typical prior art "game-used" memorabilia or "patch" card 10 may be assembled individually, as shown in FIG. 1, or may be assembled as a larger sheet (not shown) from which individual cards 10 are cut after lamination assembly of the substrate layers 12, 14 and memorabilia 18. In any event, the memorabilia is enclosed on all edges by the substrate layers 12, 14 such that the upper layer 14 creates a margin 19 or framing effect. The entire perimeter of the assembled card 10 has edges formed by both layers 12, 14 of the substrate and not an edge of the memorabilia 18.

Figure 2:
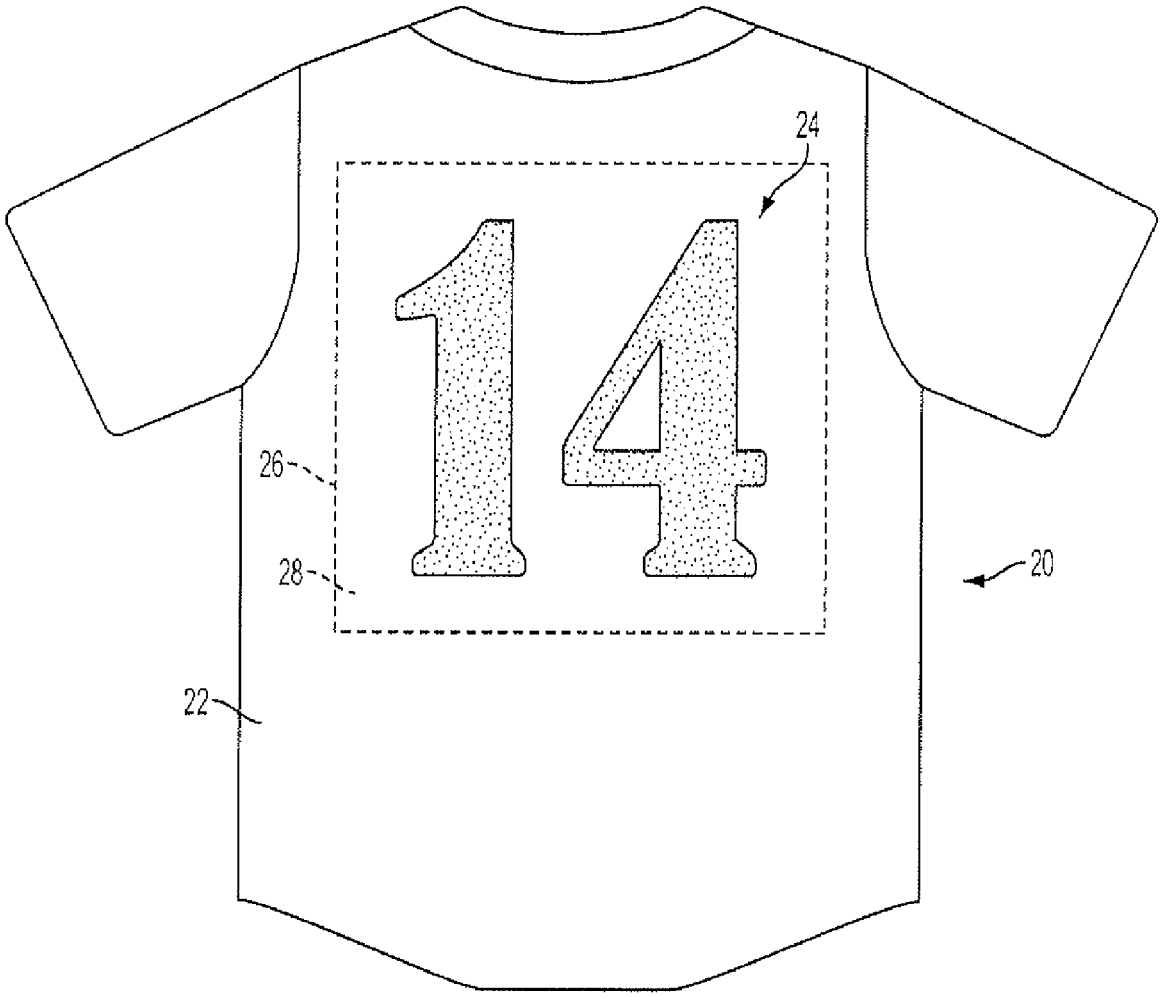
FIG. 2 shows a piece of game-used equipment memorabilia in the form of a uniform shirt from which a discrete visual attribute (player number) larger than a single trading card can be selected.
Figure 3:
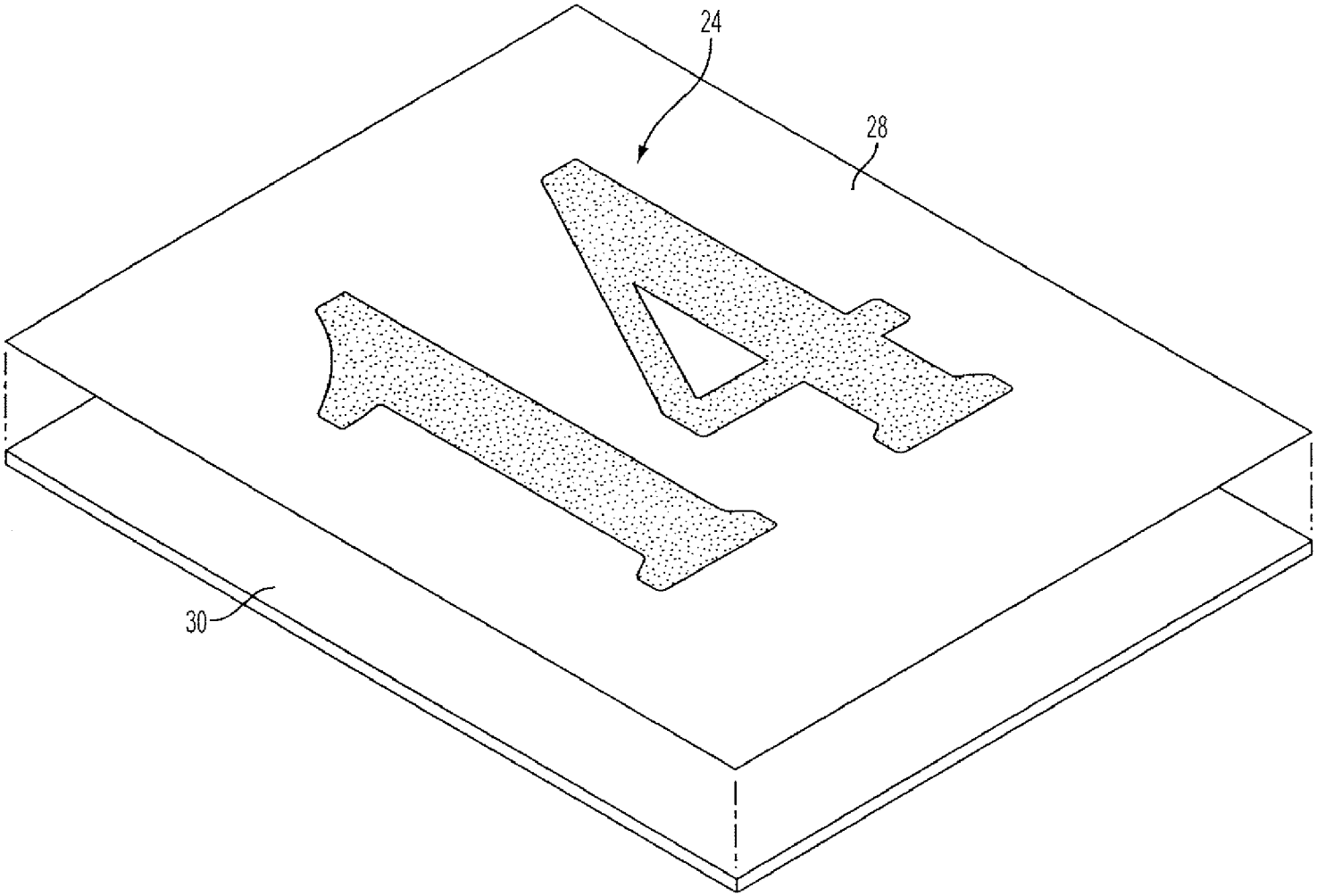
FIG. 3 shows a panel of memorabilia being assembled onto a substrate panel.

Referring now to FIG. 2, therein is shown at 20 an example of memorabilia in the form of game-used equipment, such as a baseball uniform shirt 22. The shirt 22 includes at least one discrete visual attribute, in this case the player's number, shown generally at 24. An area (designated by dashed line 26) of the shirt 22 which includes the discrete visual attribute 24 is selected and cut from the shirt 22. Other parts of the shirt 22 may be used in the making of traditional "game-used" memorabilia or "patch" cards 10 or according to the present invention if there are other appropriate discrete visual attributes.

According to a preferred embodiment of the present invention, the area 28 cut from the shirt 22 which includes the discrete visual attribute 24 is secured to a substrate 30 of approximately the same size. The substrate 30 may be cardboard or other suitable material. The selected portion of memorabilia 28 may be secured to the substrate 30 by any conventional means, including by adhesive or other form of lamination. The overall dimensions of the cut piece 28 and substrate 30 should be similar, but do not need to be exactly the same. Final cutting and/or trimming, described later, will produce a suitable cut edge. Similar sizing is desired, however, so as to reduce waste of either component 28, 30.

Figure 4:
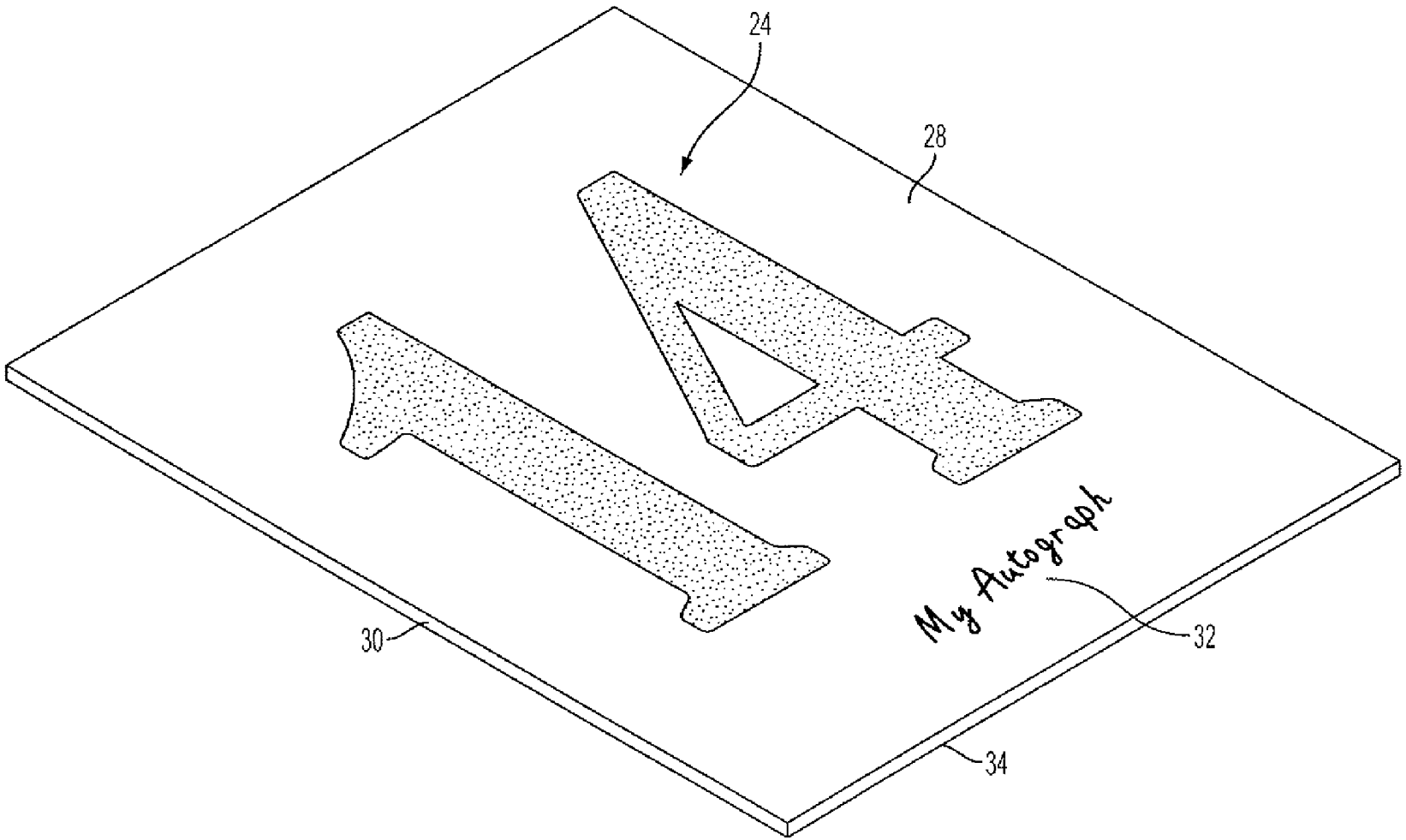
FIG. 4 shows an assembled panel with an additional visual attribute (an autograph) added.

Referring now also to FIG. 4 which shows the memorabilia piece 28 and substrate 30 in an assembled state, other visual attributes, such as an autograph 32 may be added to the cut piece 28 of memorabilia either before or after assembly with the substrate 30. The assembled panel 34 is larger in size than any single collectable trading card which may be cut from it. Likewise, at least one of the visual attributes 24, 32 is also larger than that of any typical single trading card.

Figure 5:
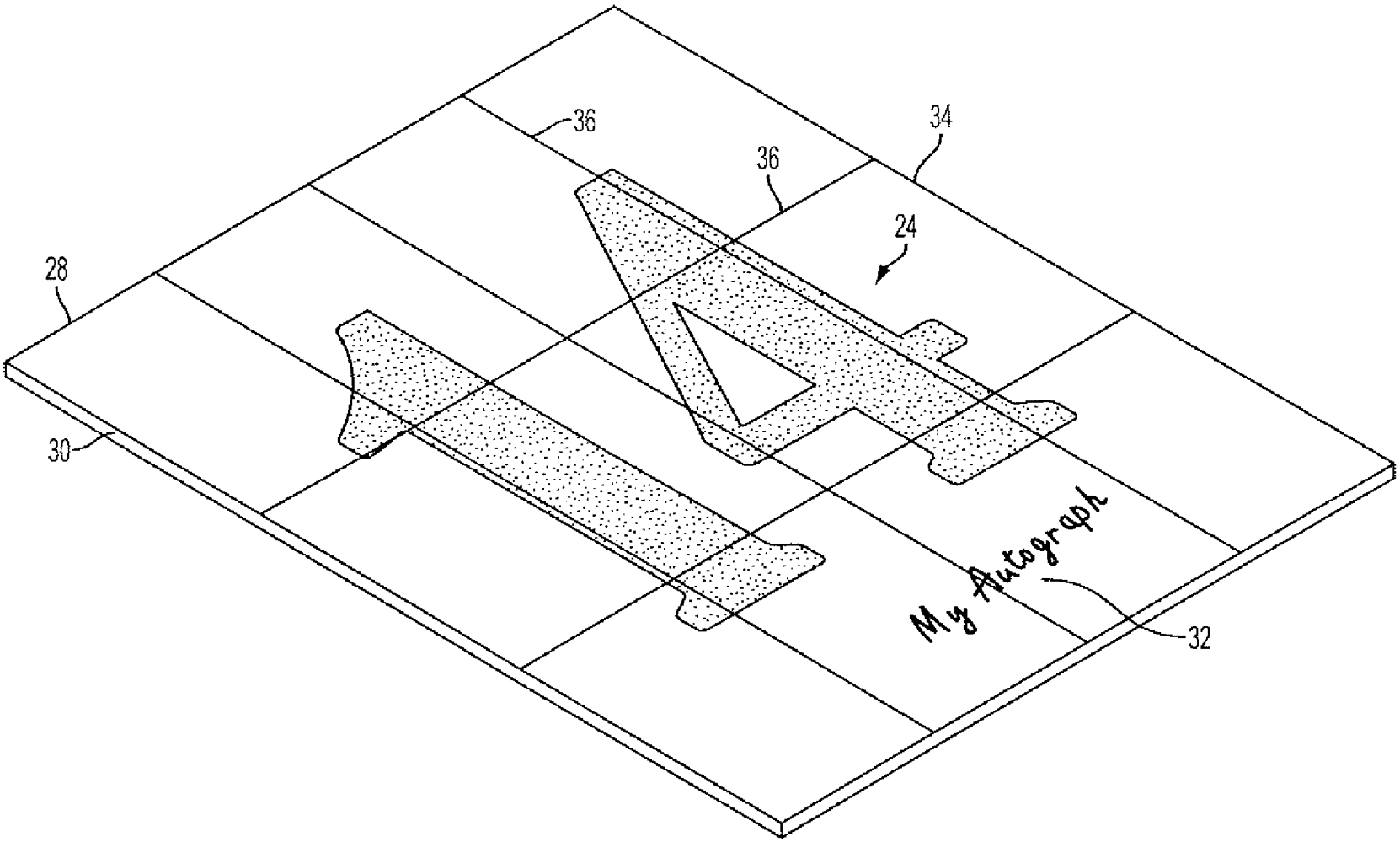
FIG. 5 shows the manner in which the panel of FIG. 4 may be cut into a set of cards.
Figure 6:
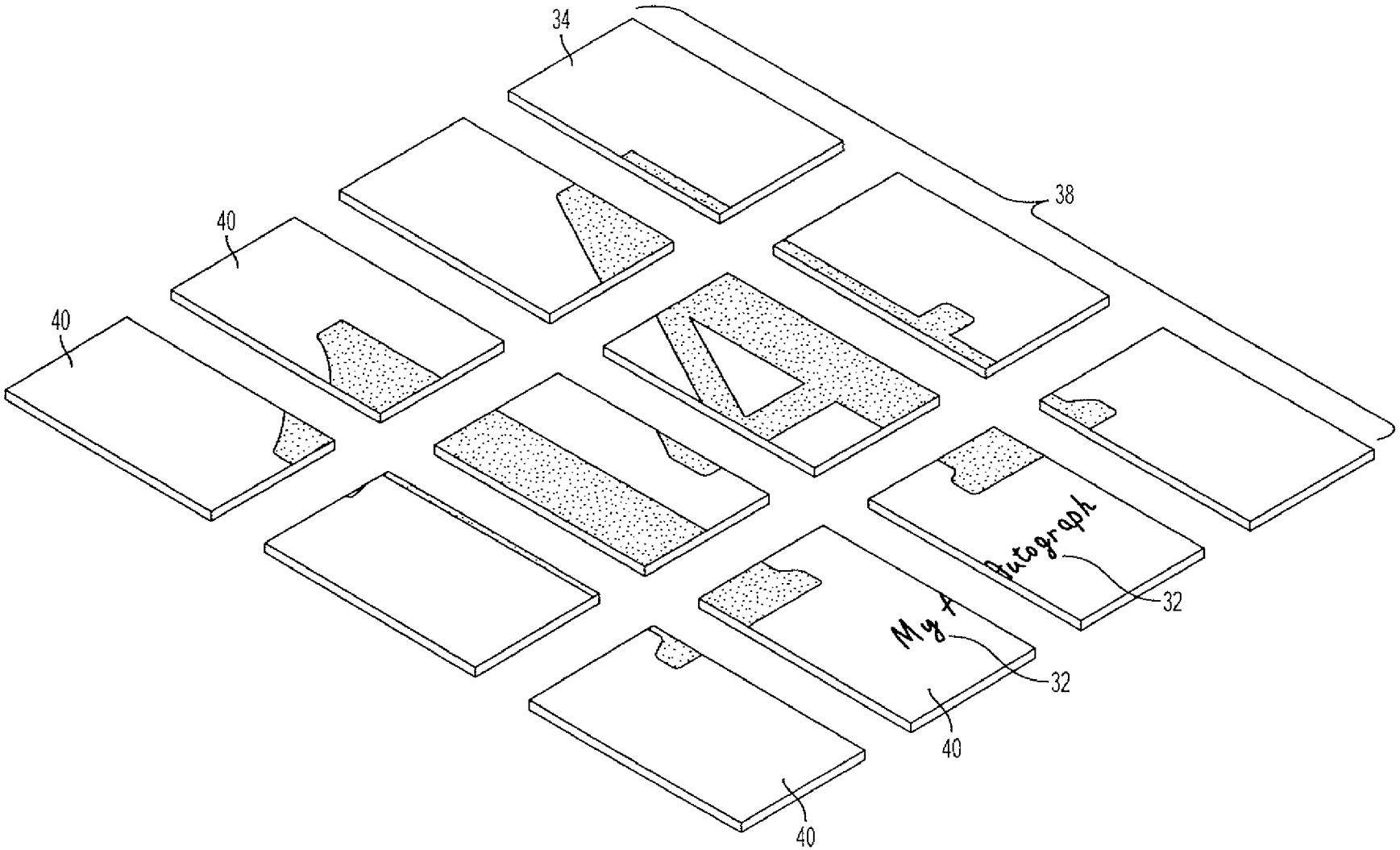
FIG. 6 shows a set of cards according to the present invention cut from the panel of FIGS. 4 and 5.

Referring now also to FIG. 5, a grid pattern 36 is determined on the panel 34 in order to divide the panel 34 into a set of individual collectable trading cards, a standard size for which is 2.5 inches by 3.5 inches (6.35 cm by 8.89 cm). FIG. 6 shows a complete set 38 of individual cards 40. In the illustrated example, the set 38 comprises twelve individual cards 40 cut from the previously unitary panel 34. Even after cutting, cards 40 of the set 38 can be reassembled by laying them in ordered proximity to one another so that substantially the entirety of the visual element 24, 32 will appear much the same as it did prior to cutting, as shown in FIG. 5. This may be accomplished because the cut edges of individual cards do not include a visible frame or border layer on top of the memorabilia piece 28, at least along those edges intended to be contiguously reassembled to show the discrete visual attribute 24, 32. The memorabilia attribute 24, 32 is positioned to have a portion of the attribute 24, 32 divided between at least two of the cards 40 and extending across adjoining cut edge portions of at least two cards 40 of the set 38 to provide a borderless appearance.

Cards 40 of a set 38 may be cut utilizing a die, a laser, or by any other suitable means. The exact manner in which layers 28, 30 of a panel 34 are adhered together or in which a panel 34 is cut into separate cards 40 is not important to the present invention. A panel 34 may be assembled prior to cutting, or the memorabilia 28 and substrate 30 may be cut separately and then assembled together into separate cards 40. A sealing material may be used to secure the cut edges and prevent fraying, delamination, or separation of appliqué layers. As used herein, cut edge portions of the cards of the present invention are considered to have a borderless appearance so long as at least a portion of the cut edge of the first layer is substantially free of a significant margin, visible overlay, or framing layer and create a substantially contiguous appearance when the edges of adjoining cards are abutted or laid together in close proximity.

Generally the cards 40 of the present invention will not include any additional printed indicia on the side bearing the memorabilia material 28. Instead, the exposed opposite surface of the substrate 30 is printed, either before or after cutting apart, with appropriate indicia conveying information relating to the memorabilia layer 28, the larger memorabilia piece 20 from which it was cut, and/or a notable person or event associated with the memorabilia 20. Additionally, the opposite surface of the substrate 30 will include indicia associating it with the set 38 from which the individual card 40 originated. In this manner, a collector may gather all cards 40 from a unique set 38 with confidence that they will fit together to form the entirety of the visual attribute 24, 32 and that the memorabilia from each card 40 originated from a single and unique panel 28 of the memorabilia 20.

Alternatively, substantially identical (or at least dimensionally uniform) pieces of memorabilia, such as multiple similar uniforms of a single player or the logo portion of similar uniforms worn by different members of the same team, could be cut precisely so that separate cards of different panels could be assembled to form or "re-form" the visual attribute. In this regard, as used herein, "unique set" may include those cards 40 having a memorabilia layer 28 originating from a previously unitary piece of memorabilia 20, or a specifically selected group of cards 40 carrying a selected portion of memorabilia which may be assembled to visually reproduce a selected visual attribute, even if all parts did not originate from a previously unitary item.

Figure 7:
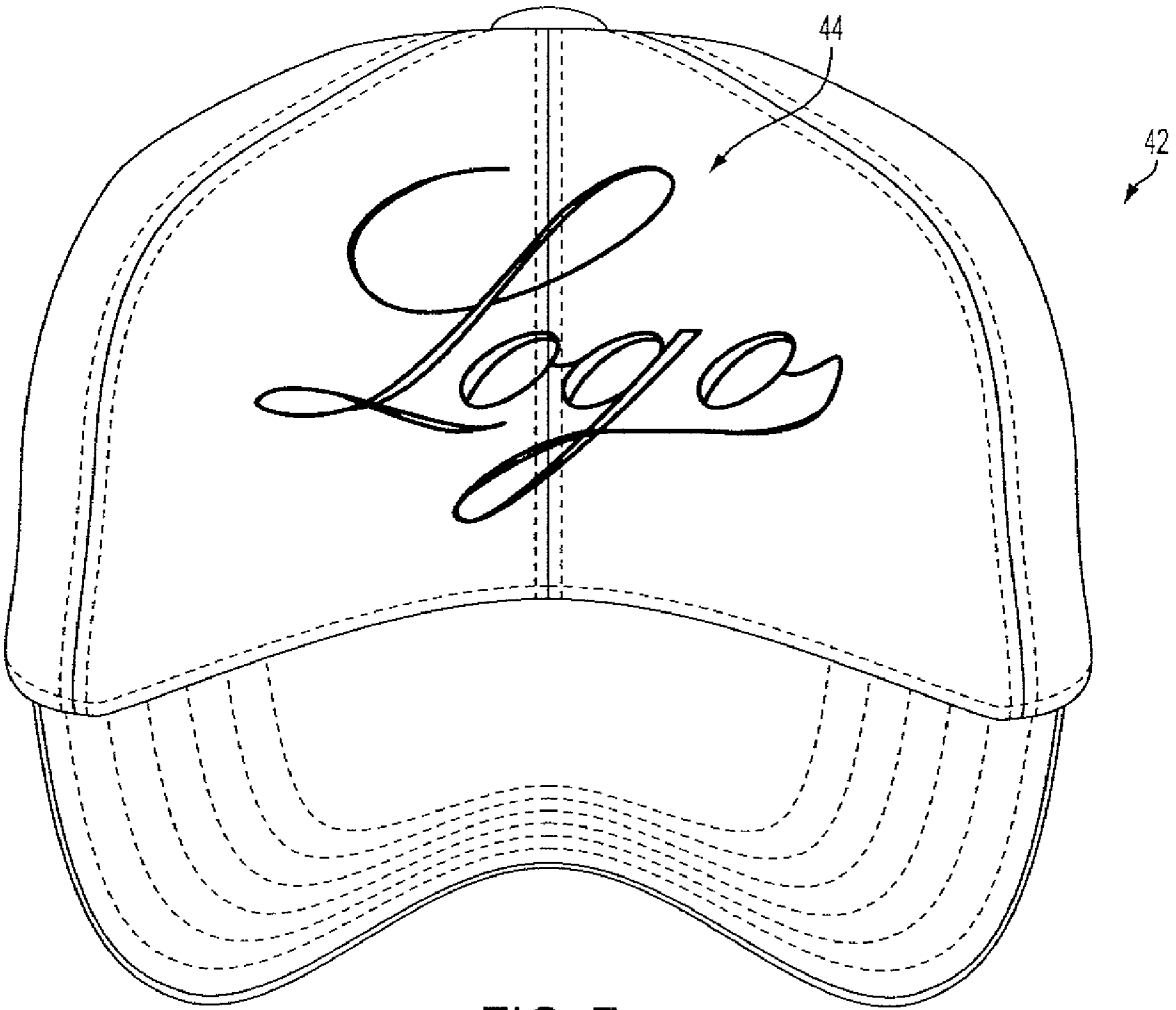
FIG. 7 shows a piece of game-used equipment in the form of a cap from which a smaller discrete visual attribute (team logo) larger than a single trading card can be selected.
Figure 8:
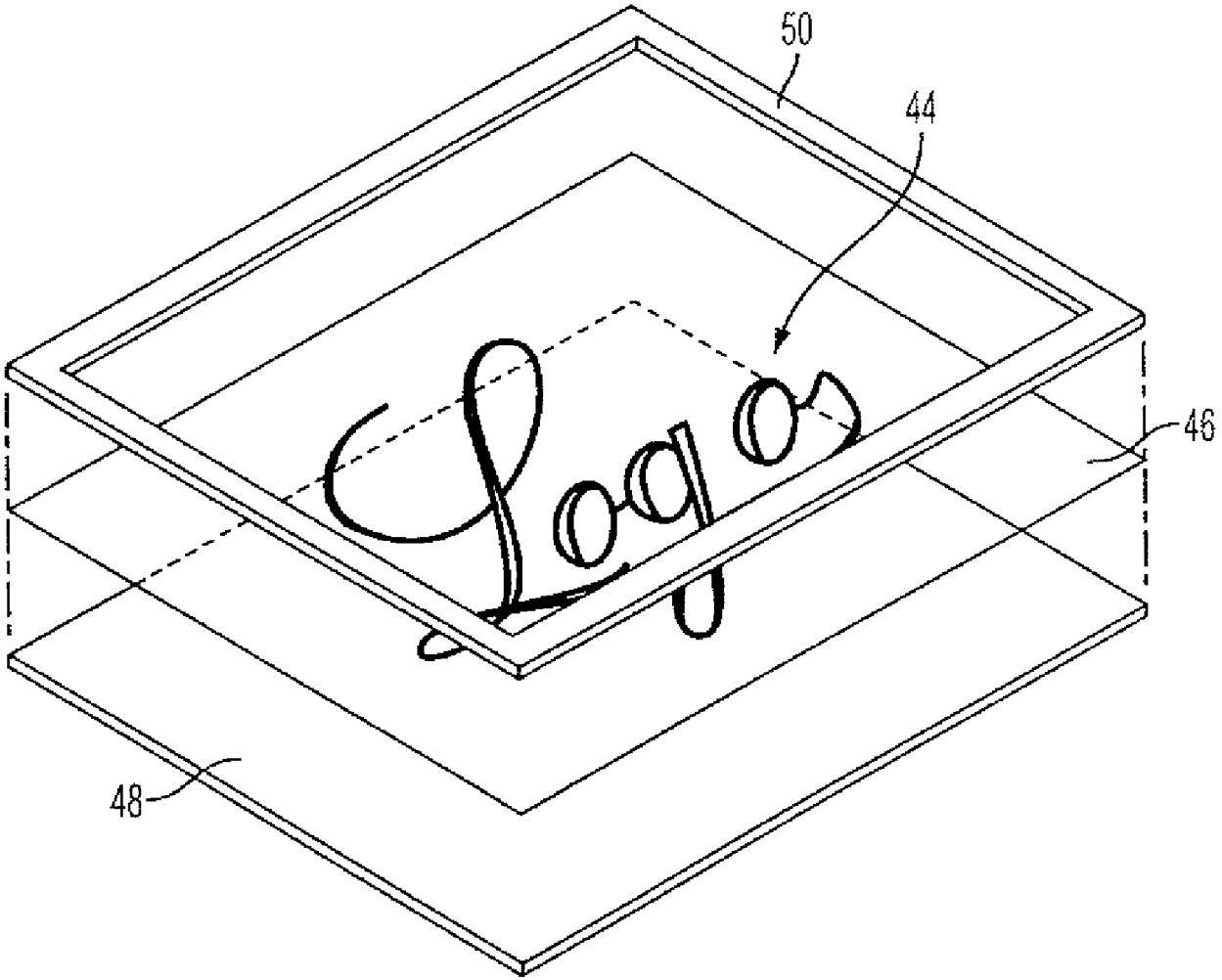
FIG. 8 shows a panel of memorabilia being assembled onto a substrate panel and a partial border.

FIGS. 7-10 show the assembly of an alternate embodiment of the present invention. FIG. 7 shows a piece of memorabilia, in this case a cap 42 having a smaller visual attribute 44, such as a team logo. Referring now also to FIG. 8, a panel 46 of material which includes the team logo 44 is cut from the hat 42 and assembled onto a suitable backing substrate 48. According to this alternate embodiment, a frame or border layer 50 may be laminated or otherwise secured on top of or extending outwardly beyond the panel 46 of memorabilia.

Figure 9:
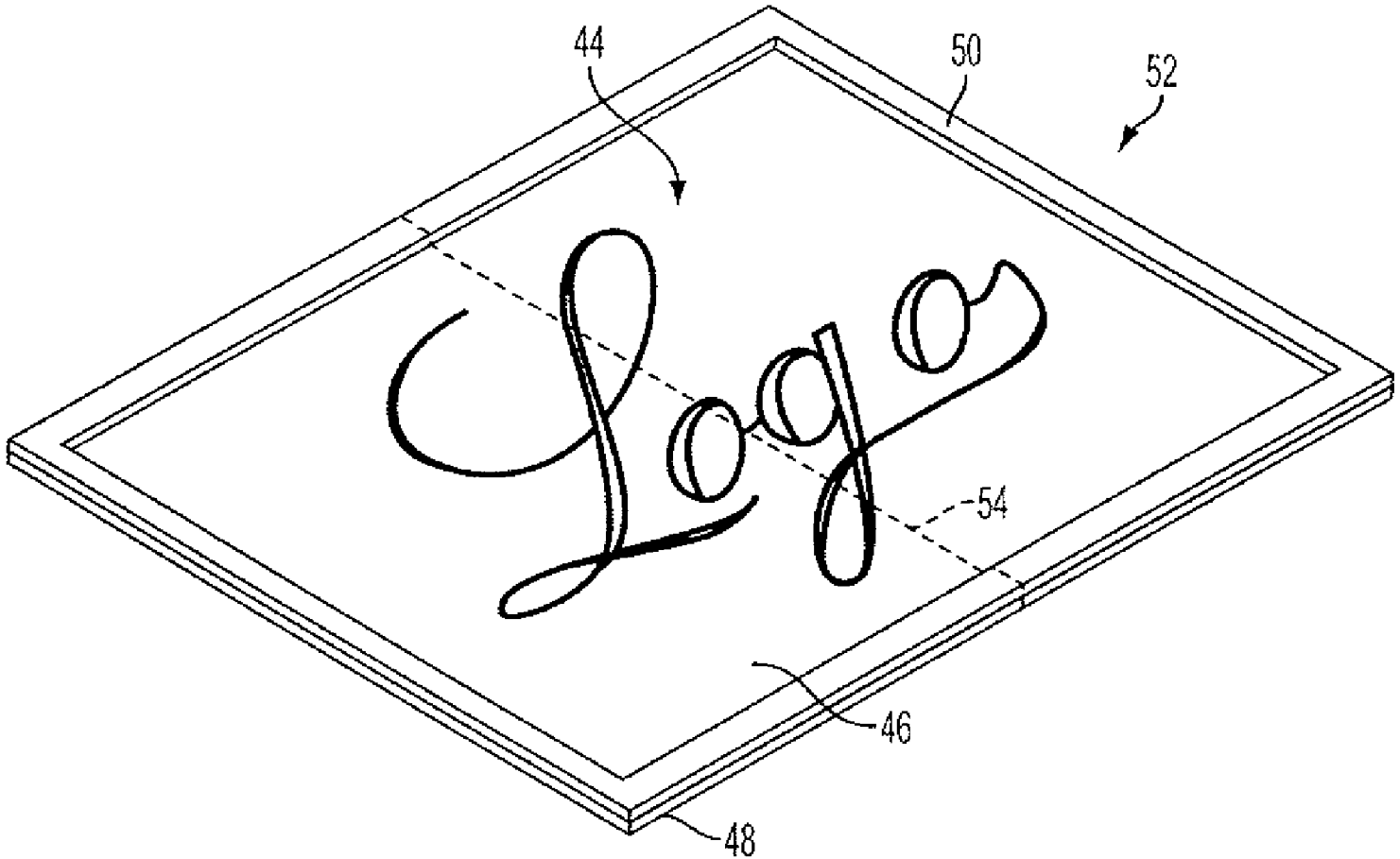
FIG. 9 shows an assembled panel and the manner in which the panel of FIG. 8 may be cut into a set of two cards that are cut along a borderless edge.
Figure 10:
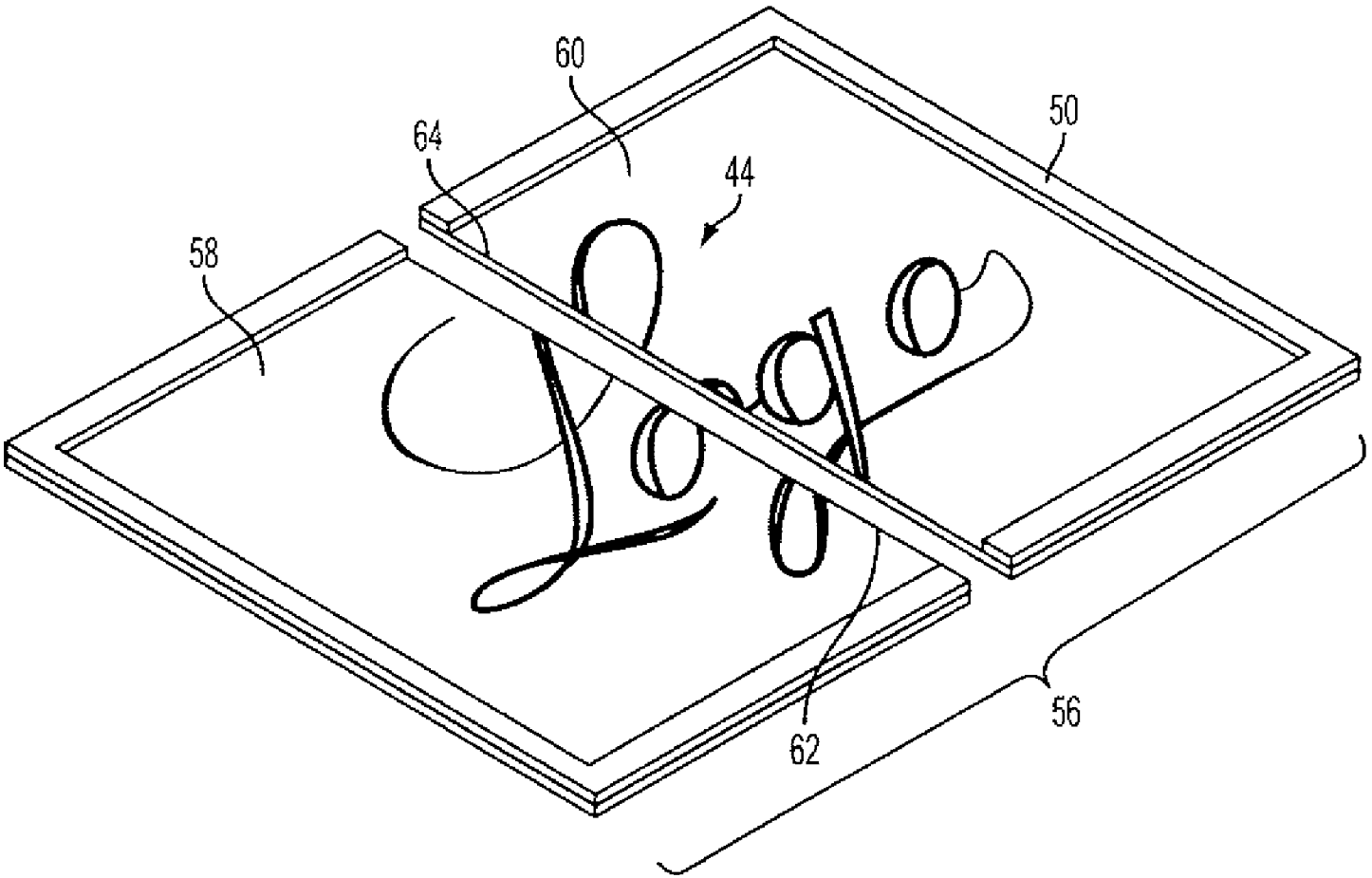
FIG. 10 shows a set of cards according to the present invention cut from the panel of FIGS. 8 and 9.

Referring particularly to FIGS. 9 and 10, the assembled panel 52 may be cut along a line 54 which separates the visual attribute 44 into more than one part. In this example, a set 56 comprises only two individual cards 58, 60. Cut edges 62, 64 of the cards 58, 60 across which the visual attribute 44 spans do not have a border or frame 50. This allows the set 56 to be reassembled by a collector without significant distortion of the visual attribute 44.

A set having a larger number of cards, for example nine, may include some cards with one or more bordered edges as well as one or more centrally-positioned cards without any bordered edges. Each card, however, has at least a portion of its perimeter without a border or frame so that cut lines that intersect the visual attribute will match contiguously without the separation of a border or framed edge. In this manner, the memorabilia attribute 44 is positioned to have a portion of the attribute 44 divided between at least two of the cards 58, 60 and extending across adjoining borderless cut edge portions 62, 64 of at least two cards 58, 60 of the set 56.

As described above, a set 38, 56 may include any number of cards 40, 58, 60, so long as that number is two or more. If desired, for example, a "set" could comprise substantially the entirety of a memorabilia item, from something as small as a wrist band to as large as the front of a uniform jersey. A "set" may or may not be unique or originate from a previously-unitary panel of memorabilia. For example, multiple similar uniforms worn by a team or multiple balls used in a particular game could be cut with sufficient precision and registry that the parts could be intermixed, but capable of arrangement into an approximation of a single unit bearing the discrete visual attribute. This assemblage could then be autographed by all members of the team, particularly such that each autograph spanned across two or more cards, for example.

In this manner, a "unique set" would be created from parts that were not previously unitary, but that would now have a new association to one another and collectable value added as a result In either of the examples (FIGS. 2-6 and 7-10) described above, wastage or selvage (not shown) may be cut away from the outer perimeter of the panel 34, 52 to the extent the panel 34, 52 exceeds the dimensional area of the set 38, 56 from which individual cards 40, 58, 60 are cut. The cut edges along which individual cards 40, 58, 60 match up may be straight lines, curves, or even an interlocking pattern. Straight lines and overall dimensions standardized in the collectable trading card industry are preferred, however. Cutting could be precisely registered to the visual attribute according to a grid (see FIGS. 5 and 9) or may be intentionally altered relative to the visual attribute to cause each set 38, 56 to be unique and not assembleable with cards of any other set. While flexible fabric, such as that from which uniforms are made is a common form of memorabilia likely to be used, the present invention is not so limited. Although memorabilia material such as the fabric of a uniform, the leather covering of a ball, or other item capable of being flattened and adhered to a substrate backing is preferred, the present invention does not exclude the possibility of three-dimensional cards, or three-dimensional panel units from which substantially two-dimensional cards are cut, which may be reassembled by a collector into a three-dimensional form approximating that of the original.

Figure 11:
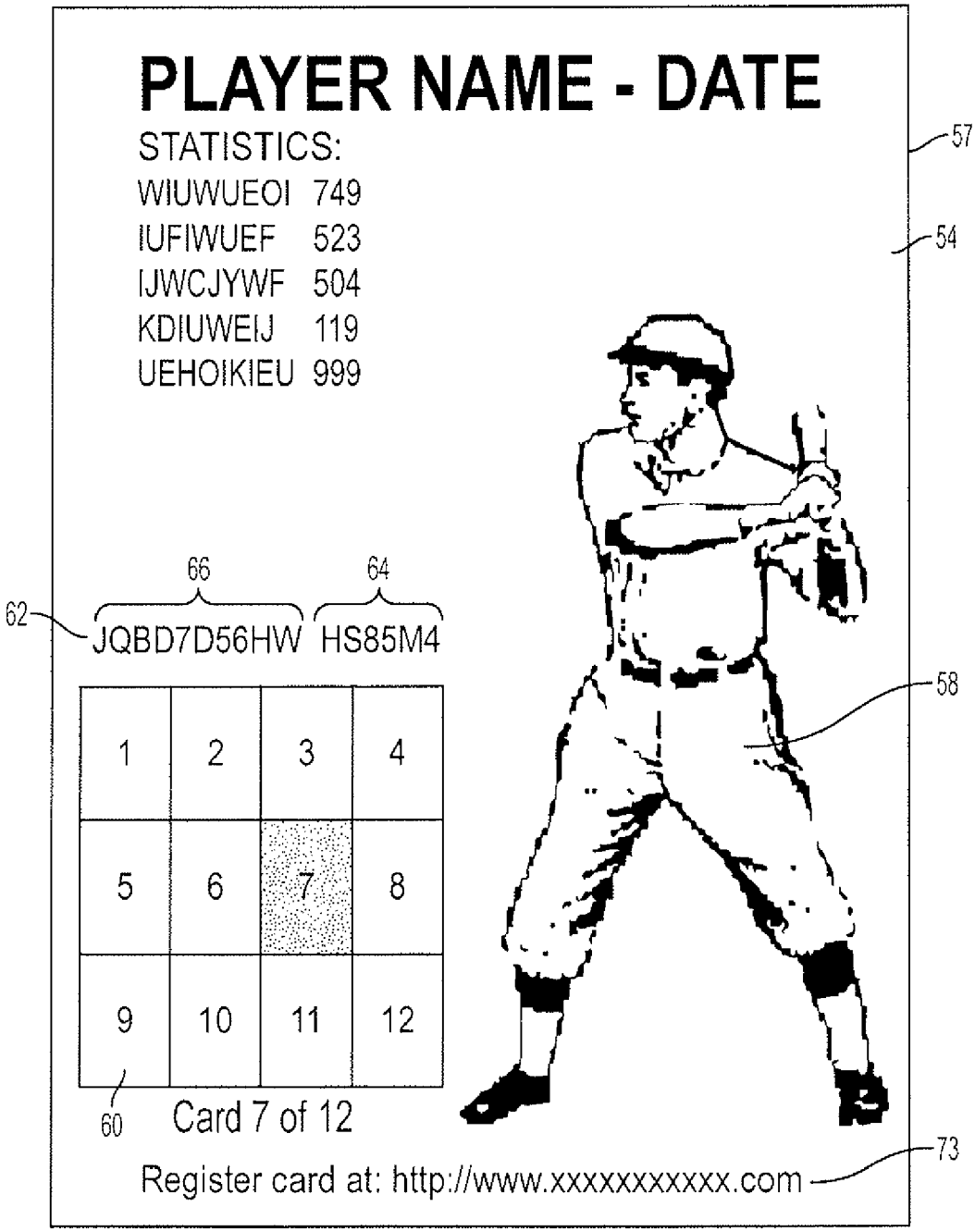
FIG. 11 shows printed indicia on the back surface of the substrate layer of a card.

Referring now to FIG. 11, therein is shown a back surface 54 of a card 57 according to the present invention on which various indicia is printed. The indicia could include, for example, a picture 58 of a notable person using, wearing or otherwise associated with the memorabilia which makes up at least a substantial portion of the opposite side surface.

Various data, such as names, dates or statistics, as are commonly found on traditional trading cards, may be included. A chart 60 (enlarged in the figure to show detail) graphically illustrating the total number of cards in the set from which the individual card 56 was cut and its position relative to the entire set may be shown. This chart 60 may include a depiction of the entire visual attribute to be formed by gathering and assembling all cards of the set, but this may or may not be preferred for reasons described below.

Another way of associating the individual card 57 with the set from which it originated may be by inclusion of a human- or machine-readable unique identifier, such as a serial number 62, bar code (not shown), or even a radio frequency identification (RFID) chip (not shown). As shown in FIG. 11 for example, the unique identifier 62 may be an alphanumeric code. The code may be separated, if desired, into a portion 64 which identifies the particular set 38, 56 from which the card 57 was cut and another portion 66 uniquely identifying the particular card 57.

Figure 12:
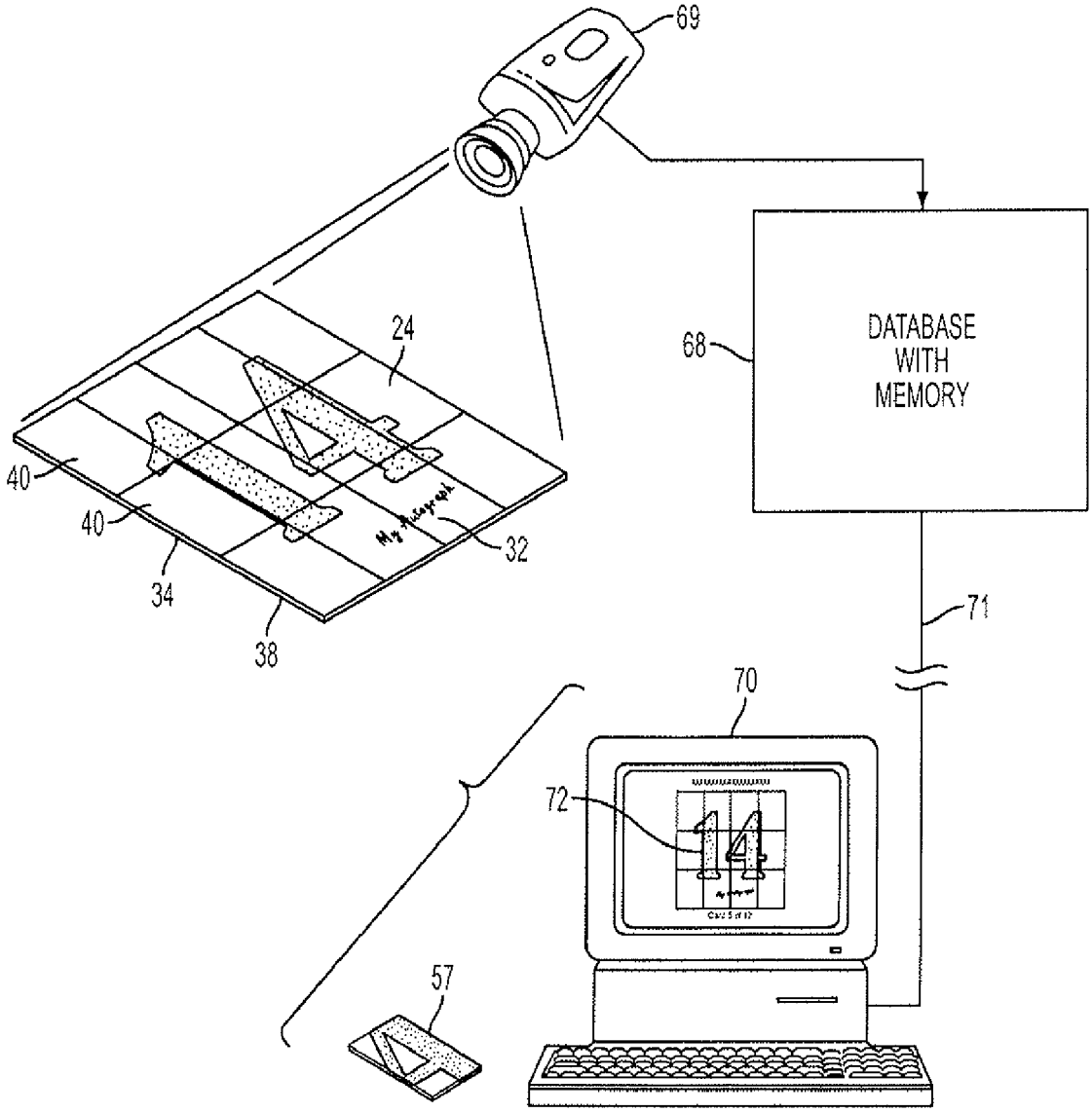
FIG. 12 shows a schematic depiction of an image of a panel being stored in a remotely-accessible database such that the entirety of the set may be viewed and an individual card may be registered based on an associated unique identifier placed on a card according to a preferred embodiment of the present invention.

Referring now also to FIG. 12, according to another aspect of the invention, a separate, electronically-stored image of the panel 34 or complete set 38 maybe stored in the memory of a computer-accessible database 68. In preferred form, the image is a digital photograph and is taken (via a digital camera or recorder 69) of the panel 38 prior to the visual attribute 24, 32 being divided between, or at least before separated into, multiple individual cards 40.

The database 68 may also include a separate, remotely-accessible registry of the unique identifier 62 of each set and each associated card thereof, such as described above and shown in FIG. 11. By making the database accessible via a global computer network (i.e., the Internet), shown schematically at 71, a collector having a network accessible computer 70 and unique identifier 62 found on a particular card 57 can access the database 68. By doing so, the collector may be provided an opportunity to view an image 72 of the entirety of the visual attribute 24, 32, the entire set 38 of cards, or the pre-cut panel 34. By not including an image of the full set 38 or attribute 24, 32 on the card 57, but instead, printing the URL address (domain name) 73 for a website providing access to the image database 68, a collector may be encouraged to access the database 68 upon acquiring a single card 57. This provides an opportunity to expose the collector to other goods and services in which he may have an interest, as well as to utilize other services described below.

According to another aspect of the present invention, a collector may enroll online (with access to the database 68) as a collector member by selecting a unique screen name and password to create an account. Other identifying information can be collected, depending on what services are offered or desired. By using the unique identifier 62 provided on each card 57, the collector member may register ownership of that card 57. Registered ownership of the card 57 may be transferred to a different enrolled collector member along with the sale or trade of the physical card. A transferable registration of cards 57 will help defeat the production and sale of counterfeit of cards. Knowing the unique identifier 62 of a particular card 57 that has been registered will be of no use to a third party or to a former owner after its registration has been transferred to a new owner/member. By randomly selecting an alphanumeric code for each card of a set, rather than using sequentially-assigned identifiers, it will be nearly impossible for a potential counterfeiter to ascertain (by guessing or otherwise) both the attribute image portion and unique identifier for any unregistered card. Once a card 57 has been registered, a prospective purchaser can verify its authenticity prior to purchase by accessing the online database 68. The unique identifier of unregistered cards will not be accessible or disclosed.

According to yet another aspect of the invention, an enrolled collector member may post a publicly-accessible and searchable list of cards that are either being sought to complete a set or that are available for sale or trade. Cards may be specifically identified by the public portion 64 of the unique identifier 62 for a card 57 or card set 38 that the collector already has in hand, or may be searched categorically in the database 68. Each time a collector member registers a new card, he can immediately determine how many cards of that set are already registered, by how many different collector members, and how many cards of the set are yet to be found. If the registrants) of other cards in the set has so designated, he can determine which are available for sale or trade and whether the newly registered card is being sought by another collector. In this way, a collector can ascertain the likelihood of his being able to gather the remaining cards of an individual set (many still unregistered or available from different collectors), or whether the card is of significant interest to another collector (it is the last remaining card needed by a collector member to complete a set).

Because of the absolute uniqueness of each of the cards 40, 57, 58, 60 according to one aspect of the present invention, an accessible database, registry, and/or brokerage service would enhance and encourage the collecting of sets of such cards that might otherwise be relatively difficult to complete after typical random and wide (separate and diverse) distribution with ordinary trading cards. The owner/operator of the database may provide a brokerage service (similar to an online auction site) for buying, selling, trading or transferring the registration of cards, if desired. Also, an enrolled collector member may choose to disclose other personal information, such as favorite teams, players, or types of memorabilia cards sought, as part of a member profile. Such a member profile will allow other members having similar interests to be located and identified, as well as facilitating the location and exchange of specific cards and/or social networking.

The foregoing detailed description of preferred embodiments is given primarily for clarity of understanding to a person of ordinary skill in the art. No unnecessary limitations are to be inferred therefrom, for modifications can be made by those skilled in the art upon reading this disclosure and may be made without departing from the spirit of the invention and scope of the appended claims.

What is claimed is:

1. A collector-targeted, memorabilia-bearing trading card set, comprising:

a plurality of individual cards associated with and assembleable into a unique set, each card of said set formed from at least two layers of material, a first layer being at least a portion of memorabilia having a visual attribute exposed on one side of the card and a second layer that comprises a substrate and provides an opposite side surface of the card;

said opposite side surface of each card of the set having indicia conveying information related to the memorabilia of the first layer and identifying the individual card with a position for assembling said individual card into the unique set with which it is associated;

each of said cards having a perimeter, at least a portion of which comprises a cut edge of the first layer with a borderless appearance; and said memorabilia attribute positioned to have a portion of the attribute divided between at least two of said cards and extending across adjoining cut edge portions of at least two cards of the set with a borderless appearance such that, when cards of a set are placed together, the visual attribute is unified substantially without interruption.

2. The trading card set of claim 1, wherein the memorabilia comprises game-used equipment.

3. The trading card set of claim 1, wherein the visual attribute comprises an autograph.

4. The trading card set of claim 1, wherein the information conveyed by the opposite side indicia includes identification of each card's spatial relationship to at least one other card in the set.

5. The trading card set of claim 1, wherein the entire perimeter of at least one card in the set comprises a cut edge of the first layer with a borderless appearance.

6. The trading card set of claim 1, wherein said indicia includes an identifier unique to each card that facilitates the identification of all cards in a unique set which together display the visual attribute of the memorabilia.

7. The trading card set of claim 6, further comprising a separate, electronically-stored image of the complete set viewable by a collector and associated with the unique identifier of each card of the set.

8. The trading card set of claim 6, further comprising a separate, remotely-accessible registry of the unique identifier of each set and each associated card thereof, wherein a collector can register ownership of a card and subsequently transfer registration of the card to another collector.

9. The trading card set of claim 7, wherein the image is a digital photograph.

10. The trading card set of claim 9, wherein the photograph was taken prior to the attribute being divided between the plurality of said cards.

11. The trading card set of claim 6, wherein the first layer of all cards in a unique set originate from the visual attribute of a previously-unitary panel of memorabilia.

12. The trading card set of claim 8, wherein said registry facilitates locating and exchange of cards so that multiple cards from a unique set may be reassembled into a collection of a single collector.

13. The trading card set of claim 1, wherein cards of a set are cut from a unitary panel, said visual attribute being smaller in area than the panel and larger than the area of any single card of the set.

14. The trading card set of claim 1, wherein cards of a set are distributed separately and diversely along with ordinary trading cards.

* * * * *